United States Patent [19]

Davis

[11] 3,983,733

[45] Oct. 5, 1976

[54] DIE FOR FORMING CANS

[76] Inventor: Richard P. Davis, Perley Road, Sanbornton, N.H. 03269

[22] Filed: Apr. 28, 1975

[21] Appl. No.: 572,009

[52] U.S. Cl. ..... 72/213; 72/224; 72/347

[51] Int. Cl.[2] ..... B21B 17/06; B21D 24/00

[58] Field of Search ..... 72/224, 344, 345, 347, 72/467, 468, 212, 213, 349; 308/202, 206, 215

[56] References Cited

UNITED STATES PATENTS

| | | | |
|---|---|---|---|
| 2,145,125 | 1/1939 | Moore | 72/224 |
| 3,457,759 | 7/1969 | Doerr et al. | 72/212 |
| 3,581,539 | 6/1971 | Lauener | 72/349 |
| 3,729,970 | 5/1973 | Propach et al. | 72/212 |

FOREIGN PATENTS OR APPLICATIONS

| | | | |
|---|---|---|---|
| 1,267,032 | 6/1961 | France | 72/224 |

*Primary Examiner*—Lowell A. Larson

[57] ABSTRACT

A die for performing the ironing process in the manufacture of drawn and ironed food or beverage cans. A number of rollers are mounted in a carriage to form a ring of suitable inner diameter to perform the desired amount of reduction in the thickness of a can mounted on a mating punch. Each roller has a concave peripheral surface which forms a small segment of the ring. The rollers have conical end surfaces which butt together closely at the inner diameter. On the outer side of the ring, the rollers bear on backer members. In one form of the invention the backer members are stationary strips and the carriage moves in the same direction as the can when the can passes through the die. In another form the carriage is stationary and the backer strips move in the opposite direction. In another form, the backer members are additional rollers mounted on bearings. In all cases the friction between the rollers and the can and the rollers and the backer members is primarily rolling friction.

This invention relates to the manufacture of food or beverage cans of the type known as seamless or drawn and ironed cans, and pertains more particularly to dies for performing the ironing process.

9 Claims, 13 Drawing Figures

FIG. 3
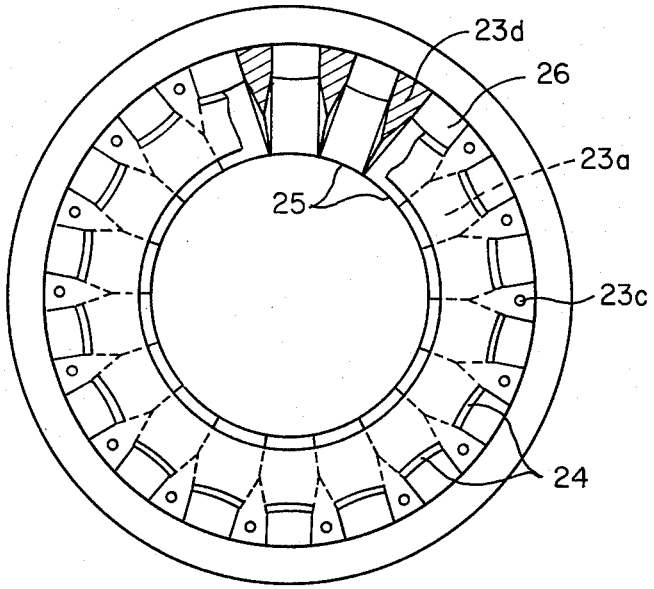
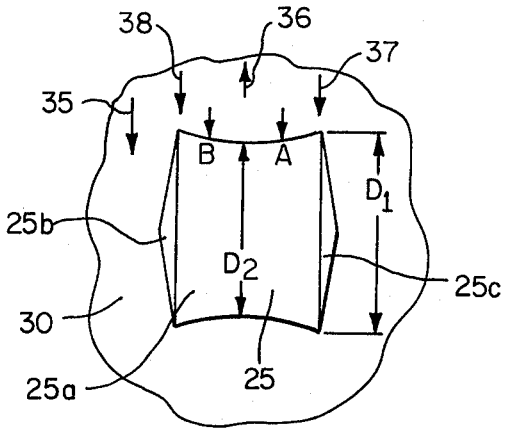
FIG. 4
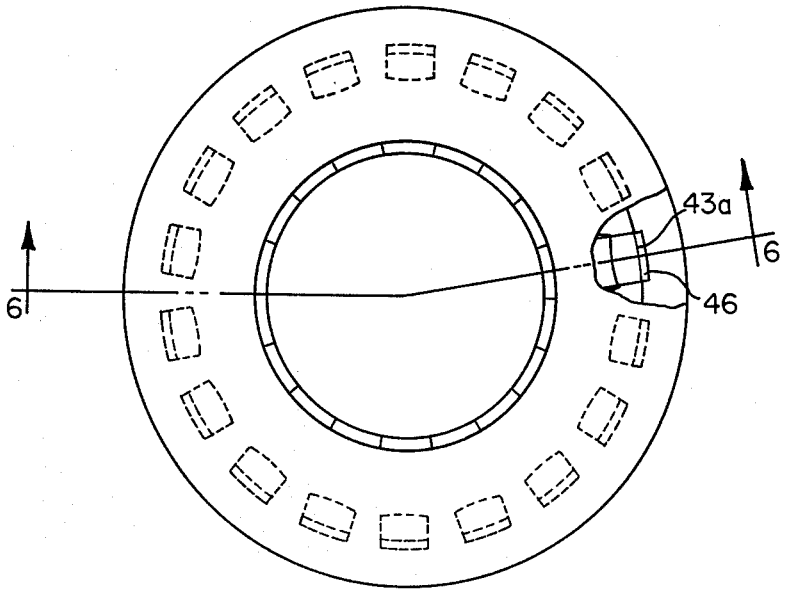
FIG. 5

FIG. 9
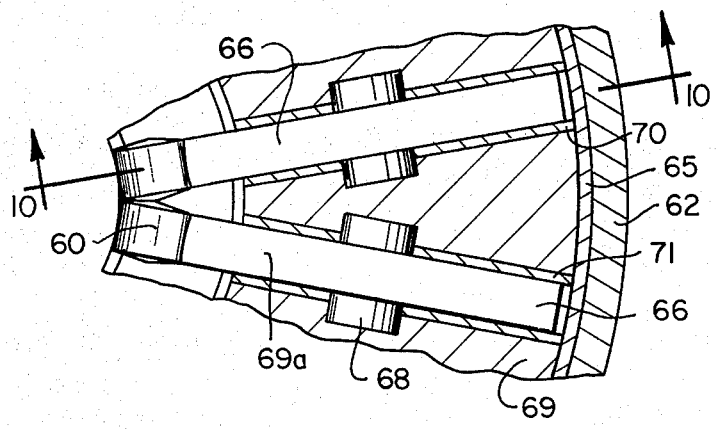
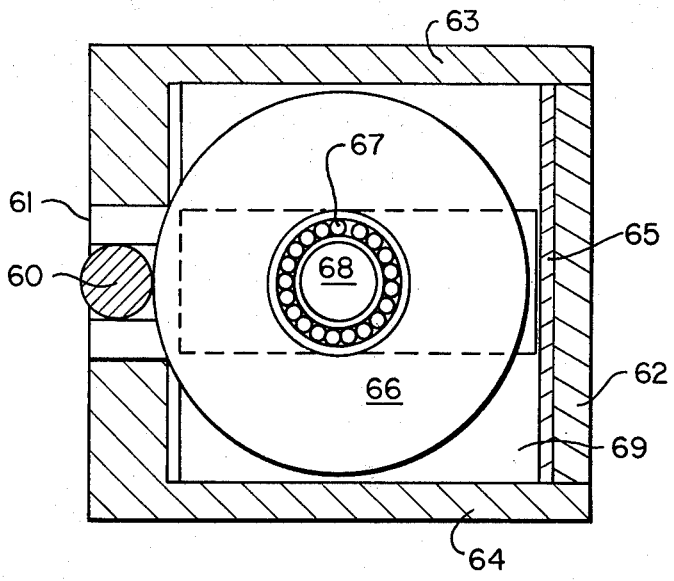
FIG. 10
FIG. 11
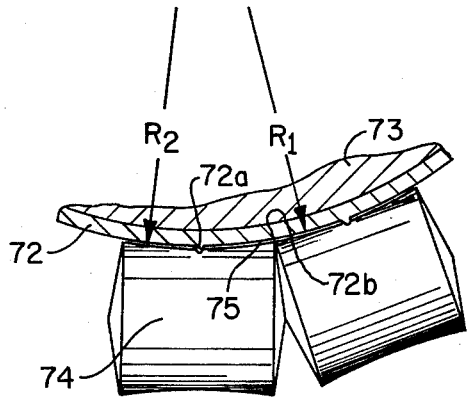

DIE FOR FORMING CANS

BACKGROUND OF THE INVENTION

According to the usual method of manufacturing drawn and ironed cans, cups are first drawn from circular blanks of flat stock. The cups have the wall thickness of the original stock. The cups are placed on a punch of a diameter corresponding to the inside diameter of the finished can, and passed through stationary ring like ironing dies to reduce and elongate the side walls of the cup to the dimensions required for the finished can.

The stationary ring dies presently used develop sliding friction with the can wall and a considerable amount of heat is generated. Furthermore the stress of forcing the can through the die is carried by the reduced portion of the can wall. Because of these factors, the speed at which the ironing process can be carried out, and the amount of reduction which can be accomplished in one pass are limited. Customarily two or more ironing rings of successively smaller inner diameter are used to reduce the can wall to the finished thickness.

The use of stationary rings in the ironing process also causes other problems. Pinholes in the material may be enlarged to the point of producing a defective can. Wear on the dies is considerable, so that they have to be periodically removed and refinished. In doing so the inner diameter is enlarged so that matched sets of punches and dies must be used to maintain uniform wall thickness in the cans. In the case of steel, for example of the type known as black plate, the presence of precipitated carbides can cause damage to the dies.

The principal object of this invention is to achieve a considerable reduction in the friction generated between an ironing die and the can wall during the ironing process, thus reducing the problems associated with high friction, and prolonging the life of the dies. Another object is to provide a die which tends to close rather than enlarge pinholes and to distribute precipitated carbides and minimize their effect. Another object is to provide a die which can be refinished to its original diameter. Other objects, advantages, and novel features will be apparent from the following description.

SUMMARY

The die here described consists essentially of a number of rollers arranged in a ring having an inner diameter corresponding to the outer diameter to which the wall of the can is to be reduced in passing through the die. The die is mated with a punch of the usual type, with an appropriate clearance to perform the desired reduction in the thickness of the side wall of a can mounted on the punch. The rollers are retained in a carriage which holds them in the correct alignment.

Each roller has a concave peripheral surface corresponding to a segment of the inner surface of the die. The rollers are relatively short so that each forms a small segment of the inner circumference of the die. The rollers have conical end faces sloped at such an angle that the rollers butt together closely at the inner circumference of the die.

Behind each roller the carriage has openings to admit backer members shaped to conform to the peripheral surfaces of the rollers, so that the radial stress resulting from the ironing action is transmitted to these members. In one version of the die, using straight strips as backers, the carriage moves with the can along the backer members at a rate slower than that of the can. In another form, the carriage is stationary and the backers are driven in the opposite direction. In another form, additional rollers are mounted behind the ironing rollers. In all cases the friction between the rollers and the can and the rollers and the backer members is predominantly rolling friction.

DESCRIPTION OF THE DRAWINGS

In the drawings illustrating the invention:

FIG. 3 is a cross-section, partly broken away, taken along line 3 — 3 of FIG. 2;

FIG. 4 is an enlarged side view of a roller illustrating schematically the action of the roller on the material of the can wall;

FIG. 5 is an end view of a modification of the die;

FIG. 9 is a transverse cross-section of another modification of the die, with roller backer members;

FIG. 10 is a cross-section taken along line 10 — 10 of FIG. 9;

FIG. 11 is an enlarged schematic view showing use of the die for loosening the can on the punch;

DESCRIPTION OF THE INVENTION

Figure 1:
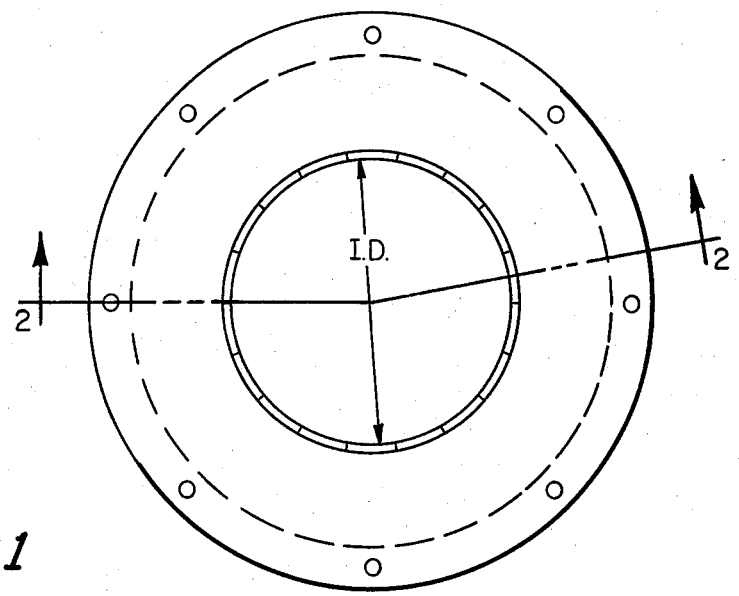
FIG. 1 is an end view of a die constructed according to the invention.
Figure 2:
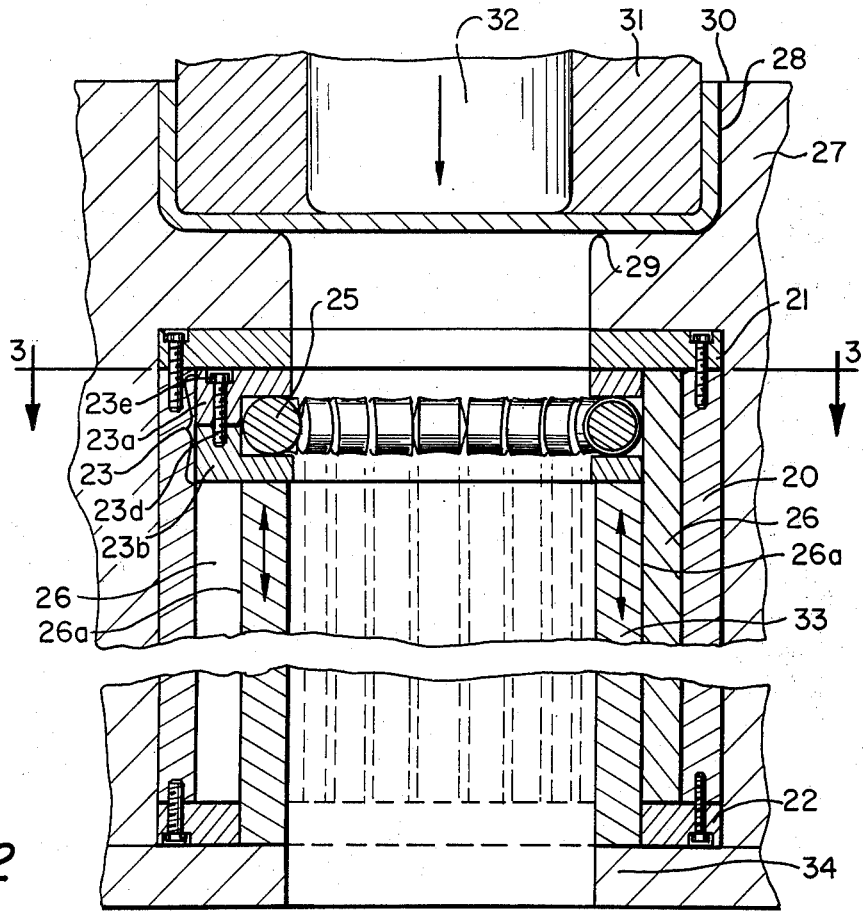
FIG. 2 is a cross-section taken along line 2 — 2 of FIG. 1.

Referring to FIGS. 1, 2, and 3, the parts of the die are enclosed in a tubular housing 20 with attached ring shaped end plates 21 and 22. The end plates are preferably belted to the housing so that they can be easily removed to allow the interior parts to be taken out when it becomes necessary to refinish the rollers.

A ring shaped carriage, generally indicated by the numeral 23, is slidably mounted in housing 20. The carriage is here illustrated as made up of two mating sections **23*a* and 23*b*. A number of rollers 25 are mounted in a ring around the inner part of the carriage. The carriage has openings 24 around its outer part, exposing the rollers, and rib portions 23*c* and 23*d*** extending between the outer parts of the rollers. The sections of the carriage are bolted together in the region of the rib portions.

The inner diameter of the ring formed by the rollers is marked I.D. in FIG. 1. As shown in FIG. 4, a typical roller 25 has a peripheral surface **25*a* and conical end faces 25*b* and 25*c*. The slope of the end faces is such that the end faces of adjacent rollers meet on a radius of the ring formed by the rollers. The peripheral surface 25*a*** is concave on a suitable radius to form a segment of the ring formed by the rollers. The rollers are relatively short so that each forms a short segment of the inner circumference of the ring, for example, a segment of about 20° of arc.

Because of the engagement of their end faces, the rollers 25 cannot move inward. The carriage sections restrain the rollers in the axial direction and hold them in alignment. To restrain the rollers in the outward direction, and sustain the radial stress produced by the ironing process, a number of backer strips 26 are secured to the die housing, one behind each roller. The backer strips have inner surfaces 26*a* conforming to the shape of the peripheral surfaces of the rollers, and are slidably received between rib portions 23*c* and 23*d* and in openings 24 of the carriage.

As shown in FIG. 2, the die assembly is mounted in the body of a press 27 having a redraw station 29 and a cavity 28. A cup 30, previously formed by conventional means such as a cupping press, is seated in the cavity 28 and is held by the cup holder 31. A punch 32, having an outside diameter corresponding to the inside diameter desired in the finished can, is advanced into the cup. As the punch advances, the cup is carried into the redraw station where it is elongated and reduced in overall diameter without reduction in wall thickness. The redrawn cup is then advanced into the roller die. The dimension I.D. of the ring of rollers has a clearance with the punch of less than the wall thickness of the cup by an amount depending on the amount of reduction desired in the thickness of the side wall of the can.

The carriage is free to roll along the backer strips 26 in the same direction as the can and punch. To retard motion of the carriage as the can enters the ring of rollers, a tubular sleeve 33, mounted on a ring shaped plate 34, engages the end of the carriage section 23*b*. The movement of the plate and sleeve is controlled by any suitable means (not shown) so that, as the can progresses through the die, the roller will be rolling along the backer strips at the same speed as they roll with respect to the can. The friction between the rollers and the can and the rollers and the backer strips is thus predominantly rolling friction.

Because of the fact that the rollers have concave surfaces, it is not possible to achieve pure rolling friction. The effect of the curvature of the roller surface is illustrated in FIG. 4. The cross-sectional diameter of the roller 25 varies from D1 at the ends to D2 at the center. The surface speed at any point on surface 25*a* is proportionate to the diameter. If the roller is rolling freely, its peripheral speed will be equal to the rate of travel of the can 30 in the direction of arrow 35 at two points A and B intermediate the center and the ends of the roller. At the center the speed will be slower than than of the can, giving rise to sliding frictional force in the direction of arrow 36. At the ends of the roller its surface speed will be faster than that of the can, giving rise to frictional forces in the direction of arrows 37 and 38. If the roller is short, forming only a small segment of the circumference of the die ring, and its mean cross-sectional diameter is substantial with respect to its length, the difference between D1 and D2 is relatively small. The speed differentials, and resulting stresses can thus be kept low enough to be acceptable, and the friction between the can and the roller as a whole approaches the magnitude of pure rolling friction as compared to sliding friction.

Figure 6:
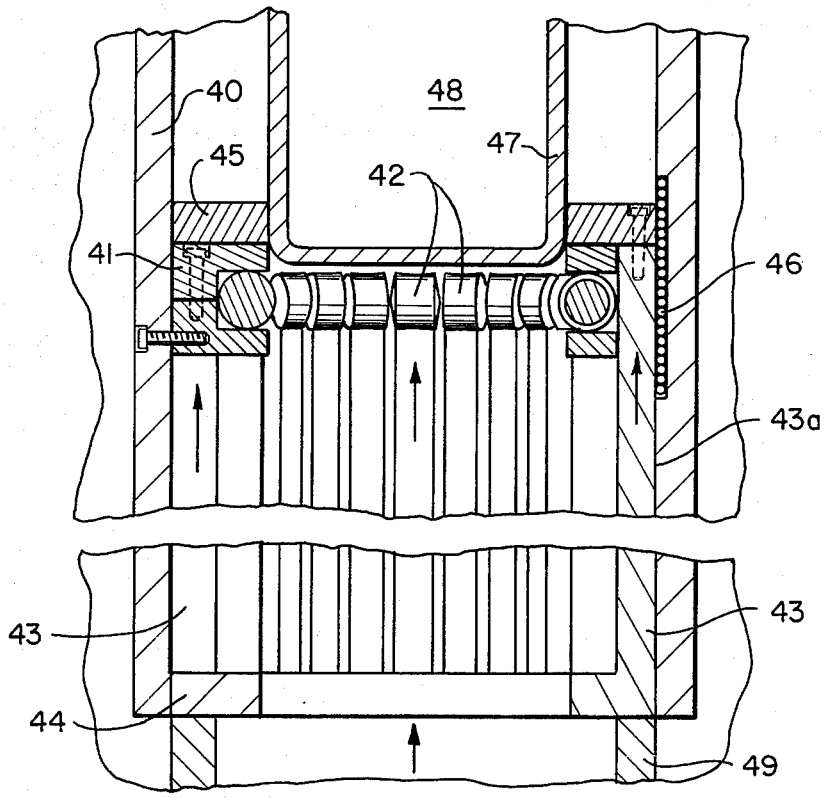
FIG. 6 is a cross-section taken along line 6 — 6 of FIG. 5.

FIGS. 5 and 6 illustrate a die assembly in which the carriage and roller assembly is stationary and the backer strip assembly moves in the direction opposite to that of the can, as the can passes through the rollers. The parts of the die are contained in a tubular housing 40. A carriage 41, similar to carriage 23 is secured to the housing and carries rollers 42. A number of backer strips 43 are disposed one behind each roller and secured to end plates 44 and 45 which are slidable in housing 40. The backer strips have flat rear surfaces 43*a* which bear against needle bearings 46 which are recessed into the housing. The surfaces of the backer strips which bear against the rollers are shaped to conform the the peripheral surfaces of the rollers.

As the can 47 supported on the punch 48 advances through the roller assembly, the backer strip and end plate assembly is driven in the opposite direction, for example by advancing a tubular sleeve 49, so that the relative speed between the rollers and the backer strips is the same as that between the rollers and the can. This form of die allows the stroke of the press to be substantially shortened.

One advantage of the die just described is that the rollers can be refinished when their surfaces become warn or scarred, and reassmbled so that the dimension I.D. is the same as it was originally, thus eliminating the need for changing the punch to maintain uniform wall thickness in the finished cans. This feature also insures that the cans produced be the die will be of uniform size and volume.

Figure 7:
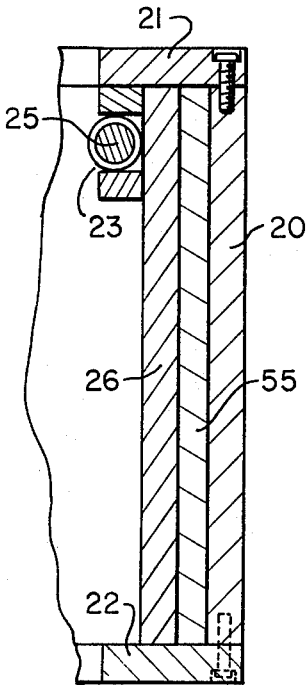
FIG. 7 is a fragmentary cross-section illustrating the die of FIGS. 1 and 2 after the rollers have been refinished.

The peripheral surfaces of the rollers 25 are ground off by the amount necessary to restore a smooth finish, ordinarily about 0.001 to 0.002 inches. The end faces are ground off by an appropriate amount so that when the ring of rollers is reassembled the dimension I.D. remains the same. The mating faces of rib portions 23*c* and 23*d* are ground so that the carriage fits snugly around the rollers which have been slightly reduced is diameter. A tubular shim 55 is placed behind the backer strips 26, as shown in FIG. 7, to move the strips into close engagement with the reduced rollers.

Figure 8:
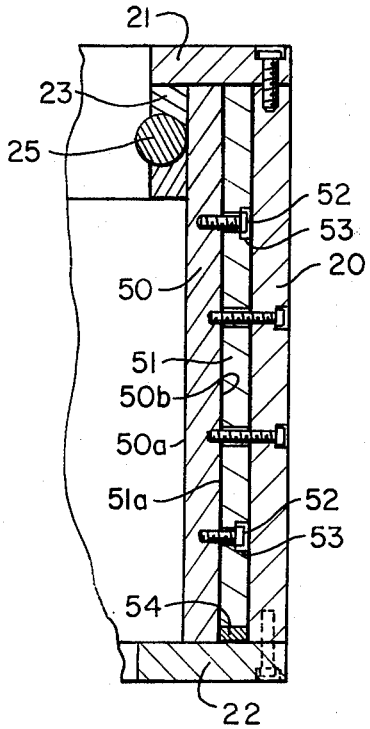
FIG. 8 is a fragmentary cross-section illustrating a modification of the backer strip whch facilitates bringing the rollers back to the original internal diameter after the rollers have been refinished.

FIG. 8 illustrates a modification of the backer strips which facilitates adjusting them to engage the rollers after the latter have been reground. Behind each roller is a backer strip 50 having an inner surface 50*a* shaped to conform to the peripheral surface of the roller, and a longitudinally tapered outer surface 50*b* which bears against a shim 51 with an oppositely tapered inner surface 51*a*. The backer strip and shim are secured together by screws 52 extending through slots 53. A shim plate 54 is disposed under one end of shim 51. When the rollers and carriage have been reground, the upper end of shim 51 is ground off by an appropriate amount, and a larger shim inserted in the position of shim 54, to adjust surface 51*a* along surface 50*b* and move the backer strips in the required amount.

An alternate form of backer members is illustrated in FIGS. 9 an 10. As described previously a ring of die forming rollers 60 is mounted in a carriage 61. The carriage is supported by a hollow tubular frame composed on an outer housing 62 and top and bottom plates 63 and 64. Inside housing member 62 is a tubular shim 65. Behind each roller 60 is a bearing roller 66. The bearing rollers are mounted on ball bearings 67 supported on shafts 68. Like the backer strips in the dies previously described, the bearing rollers have surfaces 69*a* mating with and shaped to conform to the peripheral surfaces of die rollers 60. The shafts 68 are supported in bearing segments 69 which bear against shim 65. Shim plates 70 and 71 are interposed between each segment 69 and the adjacent bearing rollers.

When the die of FIGs. 9 and 10 is in operation, Bearing rollers 66 support the radial stress transmitted from rollers 60 during the ironing process. The bearing rollers are free to roll so that the friction between them and the die rollers 60 is predominantly rolling friction. When the die rollers are reduced in diameter by refinishing, shim 65 and shim plates 70 and 71 can be replaced by similar shims of slightly different thickness to adjust the bearing assembly so that the bearing rollers closely engage rollers 60.

It is understood that two or more roller dies of the type here described can be used to perform successive reductions in the thickness of the can wall, each die having a slightly smaller I.D. than the die preceding it. FIG. 11 illustrates how a die, which would normally be the last in the series can be modified to simultaneously remove lines left on the can wall by the junctions of the rollers of a preceding die and to loosen the can on the punch, so that the can is easier to remove after the ironing operation. A can 72 is shown mounted on a punch 73. The outer surface of the can wall is generally on a radius $R_1$. However the can wall has slight projecting ridges 72*a* formed where the ends of the rollers in the preceding ironing die butted together. The rollers 74 of the finishing and loosening die, which is constructed in the same manner of the ironing dies described, are set so that their centers are on the ridges 72*a*. The centers of rollers 74 are set on the radius $R_1$. However the peripheral surfaces of the rollers are ground to a slightly larger radius $R_2$, so that there are gaps 75 between the rollers and the can wall in the region of the ends of the rollers. It is understood that the dimensions on the drawing are exagerted for clarity. A very small difference betwen the radii $R_1$ and $R_2$ is sufficient. As the can passes through the ring of rollers 74, the ridges 72*a* are flattened and the can wall is sprung slightly in the regions 72*b* between the ridges. This tends to loosen the can so that it can be easily removed from the punch.

Figure 12:
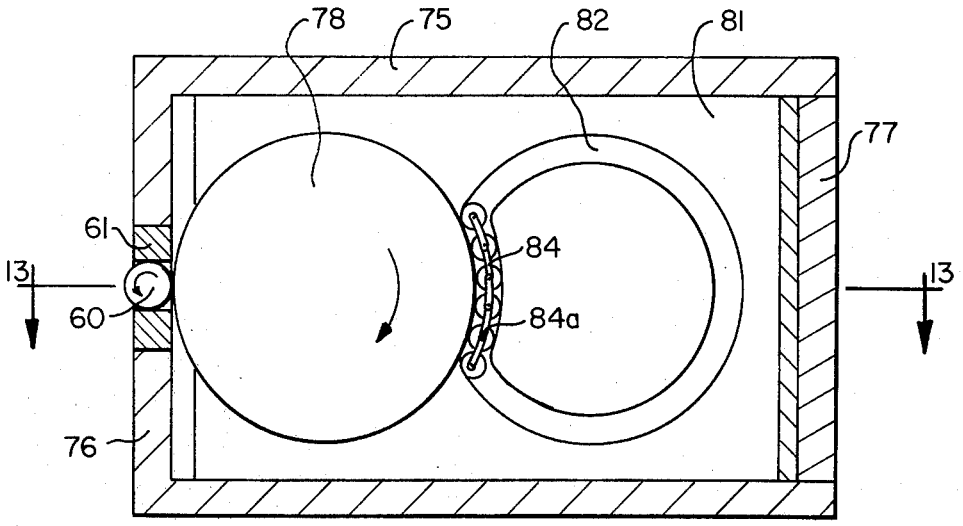
FIG. 12 is a cross-section similar to FIG. 10 illustrating a modification of the bearing for the rolling backer member.
Figure 13:
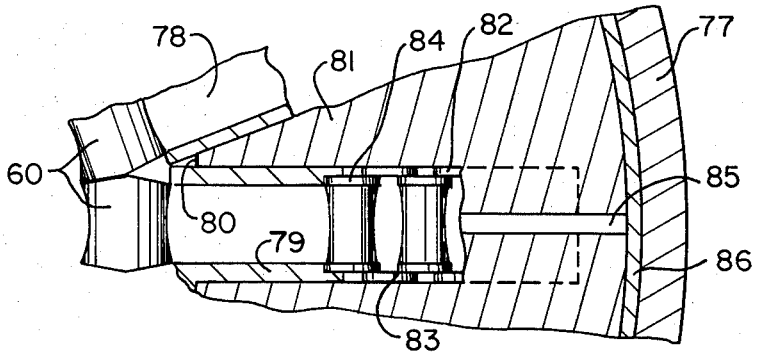
FIG. 13 is a cross-section taken along line 13 — 13 of FIG. 12.

FIGS. 12 and 13 illustrate a modified form of mounting for the bearing rollers in a die of the type shown in FIGS. 9 and 10. The ring of rollers 60, mounted in carriage 61, is supported by end plates 75 and 76 secured to a tubular housing 77. Ouside each roller 60 is a bearing roller 78. The bearing rollers are mounted between shim plates 79 and 80 supported by segments 81. The segments have grooves 81 and 82 outsides the bearing rollers. The grooves of adjacent segments mate to form a track in which a roller chain 84 is disposed. The chain forms a bearing along the outer portion of roller 78. The individual rollers 84*a* of which the chain is composed have surfaces contoured to fit the peripheral surface of roller 78. The die is provided with a tubular shim 86 and shims 85 between the segments which can be changed to move the bearing roller and segment assembly in when the die rollers 60 are refinished.

It is understood that suitable lubricating and cooling and lubricating means may be provided in the dies here disclosed, and that as many dies as needed to reduce the can wall to finished thickness may be mounted in succession, each die having a smaller I.D. than the one preceding it.

As compared to stationary ironing rings, the dies here disclosed effect a considerable reduction in friction in the ironing process, because the friction between the die rollers and the can and the rollers and their bearings is substantially rolling rather than sliding friction. Less heat is generated and less force is required to drive the can through the die. As a result the ironing process can be performed at higher speed. The rolling action also tends to close up any small holes and to distribute precipitated carbides encountered in the can material.

What is claimed is:

1. A die, for use with a punch of predetermined diameter for reducing the wall thickness of a partially formed can mounted on the punch, comprising: a number of rollers disposed to form a substantially continuous ring having a radial and a circumferential and an axial direction and an inner diameter larger than the diameter of the punch by a predetermined amount smaller than the wall thickness of the partially formed can, each of said rollers being of a length equivalent to a small segment of said ring and having a peripheral surface curved to substantially the shape of said segment; a carriage restraining said rollers in the axial direction; and bearing (means) members bearing on said peripheral surfaces and restraining said rollers in the radial direction; each of said rollers having conical end faces bearing on the end faces of adjacent rollers and maintaining the position of the rollers in the circumferential direction.

2. A die as described in claim 1, said carriage comprising a pair of rings between which said rollers are disposed, and said rings having rib portions connecting them together.

3. A die as described in claim 1, said bearing members having surfaces engaging said rollers in rolling contact and shaped to conform to said peripheral surfaces.

4. A die as described in claim 1, having a housing with a tubular interior, said bearing means comprising strips in rolling engagement with said peripheral surface., said strips being fixed to the interior of said housing and said ring and carriage being movable together in their axial direction along said strips.

5. A die as described in claim 4, said strips being composed of relatively slidable tapered members.

6. A die as described in claim 1, having a housing with a tubular interior, said bearing means comprising strips movable along said housing in the axial direction of the ring, and said ring and carriage being stationary with respect to said housing.

7. A die as described in claim 1, said bearing means comprising bearing rollers in rolling engagement with the rollers forming said ring, and the die having segments between said bearing rollers, the latter being rotatably supported on said segments.

8. A die as described in claim 1, said bearing means comprising bearing rollers in rolling engagement with the rollers forming said ring, the die having a housing surrounding said bearing rollers, and the housing carrying needle bearing engaging said bearing rollers.

9. A die as described in claim 1, said bearing means comprising bearing rollers in rolling engagement with the rollers forming said ring, the die having segments supporting said bearing rollers, said segments forming tracks and supporting a rolling chain in rolling engagement with said bearing rollers.

* * * * *